United States Patent [19]

Corse

[11] 4,213,249

[45] Jul. 22, 1980

[54] METHOD FOR PRECONDITIONING LUMPS OF SUGAR

[75] Inventor: Louis G. Corse, Chaumont-sur-Tharonne, France

[73] Assignee: Machines Chambon, Orleans-Cedex, France

[21] Appl. No.: 964,492

[22] Filed: Nov. 29, 1978

[30] Foreign Application Priority Data

Dec. 8, 1977 [FR] France ..... 77 37075

[51] Int. Cl.[2] ..... F26B 3/30

[52] U.S. Cl. ..... 34/12; 34/17; 34/39; 34/68; 127/63; 264/234; 426/241

[58] Field of Search ..... 34/4, 12, 17, 18, 39, 34/41, 68; 127/63; 264/25, 234; 426/241, 242

[56] References Cited

U.S. PATENT DOCUMENTS

| | | | |
|---|---|---|---|
| Re. 29,129 | 2/1977 | Duchateau | 127/63 |
| 3,169,888 | 2/1965 | Ryan et al. | 127/63 |
| 3,255,041 | 6/1966 | Culp | 426/242 |
| 3,582,399 | 6/1971 | Black | 127/63 |
| 3,756,855 | 9/1973 | Duchateau et al. | 127/63 |

*Primary Examiner*—Larry I. Schwartz
*Attorney, Agent, or Firm*—J. Harold Nissen

[57] ABSTRACT

This method is provided for preconditioning lumps of sugar obtained from humidified and agglomerated caster sugar, before these lumps are dried.

The sugar lumps are heated, after moulding, by means of an infra-red heating. The lumps are heated for a very short, but sufficient period of time for a cloud of steam-saturated atmosphere to be constituted around each lump, this cloud forming a barrier against the infra-red radiation and avoiding the rapid drying of the lump, and for the temperature attained by this lump on entering the oven to be higher than the dew point.

6 Claims, 2 Drawing Figures

2
4
7

1
3
2
8
4
7
6
5

METHOD FOR PRECONDITIONING LUMPS OF SUGAR

BACKGROUND OF THE INVENTION

The present invention relates to a method for preconditioning lumps of sugar obtained from humidified and agglomerated caster sugar, before these lumps are dried.

For manufacturing agglomerated sugar in lumps, loaves or the like, a moulding machine is generally used which delivers at its outlet sugar lumps having the desired dimensions and these lumps are transmitted, by a suitable conveyor, to the entrance of an oven in which the lumps of sugar continue to be displaced, with a view to their progressive drying. Up to the present, the installations for moulding caster sugar and for drying the moulded lumps comprise a moulder proper where the caster sugar is agglomerated into lumps having the desired dimensions. On leaving the moulder, these lumps of moulded sugar are taken, by a conveyor, to the entrance of a drying oven in which prevails an atmosphere at relatively high temperature and rate of humidity (for example dry temperature from 70° to 80° C. and rate of humidity of up to 72%).

These installations present the drawback that the moulder sugar lumps which leave the moulder in the open air and at a relatively low temperature, undergo a fairly considerable thermal shock when entering the oven, and moreover, a condensation of steam may be produced on these relatively cold lumps (temperature lower than the dew point), which condensation is prejudicial to the subsequent drying operation.

Certain known installations comprise, to remedy this drawback, a chamber insulating the moulder and the outgoing conveyor from the ambient atmosphere. In this chamber, the temperature and humidity are maintained high, close to the temperature and humidity at the entrance of the oven, to avoid thermal shocks and condensations.

However, these installations present numerous drawbacks concerning accessibility to the moulder parts, lubrification and corrosion thereof maintenance, etc.

It is an object of the present invention to remedy these drawbacks by providing a method enabling a moulder to be used in the open air, whilst avoiding thermal shocks on the moulded sugar lumps.

A method of manufacturing lumps of compressed sugar is also known, which uses, for drying of the lumps, infra-red ray heating creating at the exit of the moulder a rise in temperature of the lumps of up to about 93°–100° C. in about 1 to 4 minutes, then a gradual reduction of the temperature between 66° and 82° C., still by means of infra-red heating ramps, with a view to drying the lumps by reducing their water content to less than 1%. In this process, the infra-red heating is used for drying the lumps.

SUMMARY OF THE INVENTION

The present invention envisages a particular application of the infra-red heating, not to dry the moulded sugar lumps, but to precondition them, with a view to a subsequent drying operation in an oven and to obtaining a dried sugar of excellent quality.

To this end, this method of preconditioning sugar lumps obtained from humidified and agglomerated caster sugar, before these lumps are dried, in which the sugar lumps are heated, after moulding, by means of an infra-red radiation, is characterized in that the moulded sugar lumps are heated for a very short, but sufficient period of time for a cloud of steam-saturated atmosphere to be constituted around each lump, this cloud forming a barrier against the infra-red radiation and avoiding the rapid drying of the lump, and for the temperature attained by this lump on entering the oven to be higher than the dew point.

The moulded sugar lumps are preferably subjected to an infra-red radiation wave length of about 3 or 6 microns, these wave lengths corresponding to the maxima of the curve of absorption of this radiation by the water.

The heating of the moulded sugar lumps is ensured for a sufficient period of time for the temperature attained by these products, on entering the oven, to be higher than the dew point, this thus avoiding any condensation of steam on these lumps.

BRIEF DESCRIPTION OF THE DRAWINGS

The invention will be more readily understood on reading the following description with reference to the accompanying drawings, in which.

DESCRIPTION OF THE PREFERRED EMBODIMENT

Figures 1, 2:
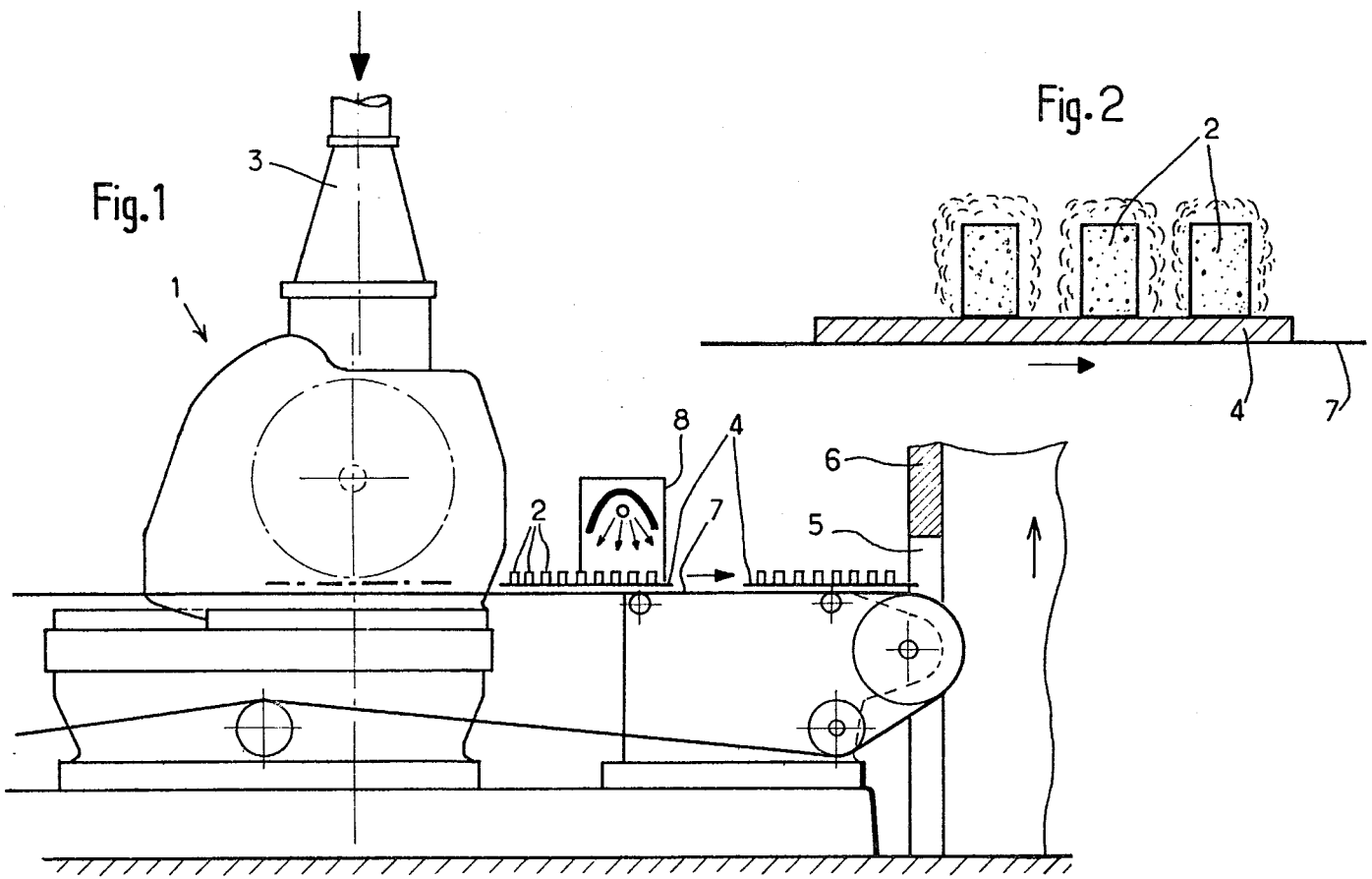
FIG. 1 is a schematic partial elevational view of a lump moulding and drying installation carrying out the method of preconditioning according to the invention.
FIG. 2 is a schematic elevational view, on a larger scale, of the sugar lumps leaving the infra-red heating device.

Referring now to the drawings, FIG. 1 schematically shows a moulder 1 for producing blocks of sugar 2 (lumps, loaves or the like) from humidified caster sugar introduced in the top part of the moulder through a conduit 3. The moulded sugar lumps 2 leave the moulder 1 on plates 4 which are displaced horizontally in translation towards the entrance 5 of a drying oven 6, in which prevails a controlled atmosphere at a temperature of 80° C. for example.

The plates 4 carrying the sugar lumps 2 are displaced towards the the entrance 5 of the oven 6 by an endless conveyor belt 7, of suitable type.

According to the invention, the installation comprises, between the outlet of the moulder 1 and the entrance 5 of the oven 6, an infra-red heating device 8 which ensures the preheating of the moulded sugar lumps, 2 on their path between the moulder 1 and oven 6. This infra-red heating device 8, of any type, comprises one or more radiation emitting ramps disposed above the conveyor belt 7, and directing their radiation downwardly i.e. in the direction of the sugar lumps 2 carried by the plates 4.

An infra-red radiation is preferably used having a wave length of about 3 or 6 microns, which corresponds to the maxima of the curve of absorption of the water.

Due to the heating of the sugar lumps 2, the water which they contain migrates towards the surface of these lumps and escapes to the outside, forming around each lump a short of humid envelope. This humid envelope constitutes a cloud of steam-saturated atmosphere, at a more or less high temperature, depending on the dwell time beneath the infra-red heating device 8. This dwell time is very short, of the order of 2 to 3 seconds. The cloud then forms a barrier against the infra-red radiation, thus therefore avoiding a rapid drying of the sugar lumps during this phase of conditioning and the defects in quality which this rapid drying might cause. The various clouds thus created around the lumps 2 are in fact formed only by a very small part of the water contained in these lumps which cannot dry, the drying operation being effected inside oven 6.

Due to the rise in temperature of the lumps 6 by the infra-red heating device 8, these lumps penetrate in the oven 6 with a relatively high surface temperature (of the order of 65° to 80° C.), higher than dew point, so that no condensation is produced on the lumps 2. Said latter thus undergo virtually no thermal shock on entering the oven 6 which is at temperature of about 80° C. at its entrance.

What I claim is:

1. A method for the preconditioning of moulded sugar lumps obtained from humidified and agglomerated caster sugar before the lumps are dried in a drying oven to avoid any thermal shock being applied to the lumps utilizing infra-red radiation upon entry thereof into the oven after moulding, comprising:

heating the sugar lumps after moulding and prior to their insertion into a drying oven for a very short period of time, but a sufficient period of time to form a cloud of steam-saturated atmosphere around each lump;

the steam-saturated atmospheric cloud forming a barrier against the infra-red radiation and avoiding the rapid drying of the lump; and, carrying out said heating so that the temperature attained upon entering the oven after moulding is higher than the dew point.

2. A method as claimed in claim 1 wherein the moulded lumps are subjected to an infra-red radiation of wave-length of about 3 or 6 microns, these wave lengths corresponding to the maxima of the curve of absorption of this radiation by the water.

3. A method as claimed in claim 2 or 1, wherein each sugar lump is heated by infra-red radiation for a duration of 2 to 3 seconds, so that the temperature of the surface layer of each sugar lump is of the order of 65° to 80° C.

4. The method as claimed in claim 1, wherein said heating of the sugar lumps preconditions the lumps prior to their subsequent drying in the drying oven.

5. The method as claimed in claim 1 or 4, wherein the heating of the lumps is carried out by subjecting the lumps to infra-red radiation of a wave length of about 3 or 6 microns to cause the water contained therein to migrate to the surface thereof and escape to form the cloud of steam-saturated atomsphere so that no condensation is produced on the lumps.

6. The method as claimed in claim 5, wherein the infra-red radiation is applied to each of the lumps for a period of 2 to 3 seconds and to a temperature between 65° to 80° C.

* * * * *